United States Patent [19]

Higashi

[11] Patent Number: 4,753,154

[45] Date of Patent: Jun. 28, 1988

[54] GUN BARREL FOR TANK

[75] Inventor: Izumi Higashi, Kanagawa, Japan

[73] Assignee: Fuji Electric Corporate Research and Development Ltd., Japan

[21] Appl. No.: 5,805

[22] Filed: Jan. 22, 1987

Related U.S. Application Data

[63] Continuation of Ser. No. 608,821, May 10, 1984, abandoned.

[51] Int. Cl.[4] ..... F41F 17/14

[52] U.S. Cl. ..... 89/14.1; 165/104.26

[58] Field of Search ..... 89/14.1; 165/104.26

[56] References Cited

U.S. PATENT DOCUMENTS

| | | | |
|---|---|---|---|
| 2,935,912 | 5/1960 | Hartley | 89/14.1 X |
| 3,820,596 | 6/1974 | Weinhardt et al. | 165/104.26 |
| 4,346,643 | 8/1982 | Taylor et al. | 89/14.1 |

FOREIGN PATENT DOCUMENTS

| | | | |
|---|---|---|---|
| 207792 | 12/1982 | Japan | 165/104.26 |

*Primary Examiner*—John F. Terapane
*Assistant Examiner*—John S. Maples
*Attorney, Agent, or Firm*—Sughrue, Mion, Zinn, Macpeak, and Seas

[57] ABSTRACT

A gun barrel structure for a tank having improved heat dissipation properties and accordingly improved accuracy. The gun barrel of the tank is surrounded by a cylindrical heat pipe containing a working fluid. The heat pipe may be constituted by concentric inner and outer cylinders with the working fluid therebetween, or by a single cylinder surrounding the gun barrel with the working fluid held between the outer surface of the gun barrel and the inner surface of the cylinder. Preferably, the heat pipe is divided into a plurality of separate sections disposed along the barrel. A wick holding the working fluid may also be employed.

26 Claims, 9 Drawing Sheets

GUN BARREL FOR TANK

This is a continuation of application Ser. No. 608,821, filed May 10, 1984, now abandoned.

BACKGROUND OF THE INVENTION

This invention relates to the barrel of a gun mounted on, for example, a tank. More particularly, the invention relates to a gun barrel provided with a heat pipe for dispersing the heat which is generated locally in the barrel by sunlight or when the gun is fired.

A tank, shown schematically shown in FIG. 1, includes a main body 1 and a gun barrel 2. The upper side of the barrel 2 has a large increase in temperature as when exposed to sunlight, but its lower side, which is not exposed to sunlight, has only a small rise in temperature. The resulting difference in the amount of thermal expansion between its upper and lower sides causes the barrel 2 having a large length l to flex downwardly at its free end by an amount δ indicated in FIG. 2. This flexure depends largely on the weather conditions, and has a significant bearing on the hit probability.

Each time the gun is fired, the barrel receives an impact from the gas which is produced by the accompanying explosion, and heat is generated by the mechanical friction between a fired shell and the surface of the bore of the barrel. The barrel is, therefore, heated to a high temperature, shortening its life. The thermal expansion of the barrel enlarges its bore diameter and thereby forms a clearance between the shell and the inner surface of the barrel. The combustion gas leaks through the clearance and wears the inner surface of the barrel. The enlarged bore diameter in turn causes a change in the contact resistance between the shell and the barrel, and this change adversely affects the initial speed of the shell and its hit probability. This is particularly the case when the gun is fired continuously. The heating is concentrated on the base end of the barrel and its upper side to which heat is transmitted by convection. It is thus necessary to provide an arrangement which promotes a uniform distribution of the heat throughout the barrel and its dissipation therefrom.

It is generally believed that the amount of heat which is transmitted to the barrel is a function of the flow speed and density of the gas in the barrel and the temperature of its flame, and that about 5 to 8% of the heat generated by the combustion of the explosive is transferred to the barrel. Only a very short time is, however, available for such heat transfer, and thus only the inner surface of the barrel is heated each time the gun is fired. If the gun is fired continuously, the inner surface of the barrel is heated to a higher temperature each time, and the whole barrel is eventually overheated until firing cannot be continued.

SUMMARY OF THE INVENTION

It is thus an object of the invention to eliminate the problems as hereinabove pointed out and to provide a gun barrel having a heat pipe for distributing the heat of sunlight and dispersing the heat generated by firing.

It is another object of this invention to provide for a gun barrel an annular heat pipe which can distribute or dissipate heat very effectively, withstand any firing shock, and support a wick in position with a high degree of stability.

It is still another object of this invention to provide an annular heat pipe which can support a wick in position with a high degree of stability, irrespective of a large reaction force resulting from firing, and particularly, a structure for supporting the wick.

It is a further object of this invention to provide a gun barrel having a heat pipe which comprises a plurality of annular pipe sections fitting about the barrel to absorb effectively a reaction force arising from firing and the thermal expansion of the barrel without striking against one another.

It is a still further object of this invention to provide an annular heat pipe which enables bolts connecting flanges to be tightened with a uniform force along its entire length, and particularly, to a structure for mounting the heat pipe on a gun barrel.

These and other objects are attained by a gun barrel surrounded by an annular heat pipe having capillary means provided in the inner pipe which define and the outer wall surface of an inner pipe which define therebetween a space filled with a working vapor. The means comprises a wick or annular grooves.

According to another aspect of this invention, a gun barrel is surrounded by a heat pipe comprising an annular heat pipe bonded thermally to the outer periphery of a cylindrical heat distributing plate.

According to still another aspect of this invention, a wick impregnated with a working fluid is provided in intimate contact with the wall surface of an inner pipe in an annular pipe of a closed double-cylindrical construction, and a wick support having a corrugated cross section and formed with vapor holes is disposed between the inner and outer pipes. The support provides a spring action to hold the wick in intimate contact with the wall surface so that the wick cannot be displaced or deformed by an impact force which occurs when the gun is fired. Only a small area of contact exists between the wick and its support, thereby restricting any localized transfer of heat through the support. The vaporization and condensation of the working fluid enable a fully effective distribution of heat throughout the the gun barrel.

According to a further aspect of this invention, a wire net defining a wick support is disposed on a wick formed from a fibrous mat having a multiplicity of small holes. The wire net is spot welded to the inner wall surface of a closed cylinder through the holes of the wick to hold the wick against any displacement in the cylinder by a reaction force upon firing.

According to a still further aspect of this invention, a heat pipe comprises a plurality of annular pipe sections fitted about a gun barrel in juxtaposed relation to one another, and an elastic damping member is disposed between every two adjoining pipe sections to absorb the reaction force arising from firing and any thermal expansion to prevent abutment of those pipe sections. This damping action protects the heat pipe from excessive stress.

According to a still further aspect of the invention, the gun barrel itself forms a part of a heat pipe, and a metal cylinder is welded or otherwise secured to the outer periphery of the gun barrel. The gun barrel and the cylinder define a space for a working fluid held therebetween, and a wick is provided on each of the outer periphery of the gun barrel and the inner periphery of the cylinder. This integral construction has the advantages of providing improved thermal conductivity between the gun barrel and the heat pipe, reducing the weight of the heat pipe, and improving its impact resistance.

According to a further aspect of this invention, the heat pipe has an axially split construction and has a generally C-shaped cross section. Each of its split edges has a flange facing a flange on the other edge. The flanges are rotatable about an axis extending parallel to the axis of the heat pipe. The flanges are connected to each other by bolts after the heat pipe has been fitted about the gun barrel. All the bolts can be tightened with a predetermined torque, while the flanges are maintained parallel to each other until all bolts are fully tightened.

DESCRIPTION OF THE PREFERRED EMBODIMENTS

Figure 1:
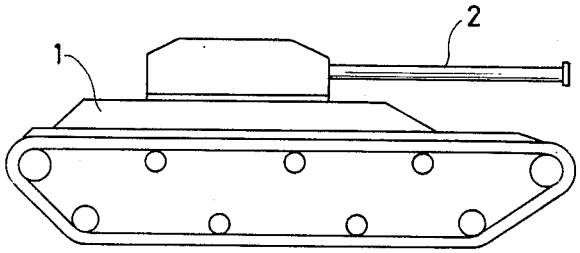
FIG. 1 is a schematic side elevational view of a tank.
Figure 2:
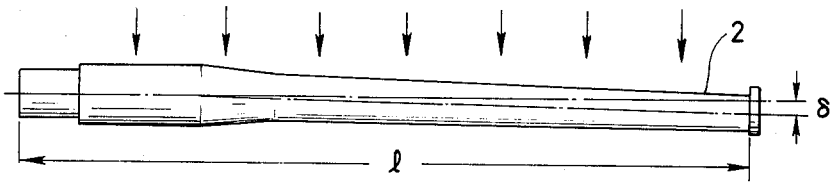
FIG. 2 is an enlarged side elevational view of a gun barrel exposed to sunlight.
Figure 3:
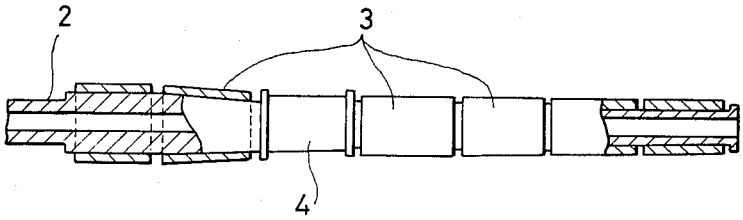
FIG. 3 is a side elevational view, partly in section, of a gun barrel provided with a heat pipe.

A first preferred embodiment of a gun barrel structure of this invention is shown in FIG. 3. This gun barrel structure includes a heat pipe assembly 3 surrounding a gun barrel 2 in intimate contact therewith so that heat can readily be conducted therebetween. The heat pipe assembly contains a working fluid, and the generation of latent heat by its vaporization and condensation gives rise to the movement of heat between a high temperature zone and a low temperature zone, whereby the heat generated locally in the gun barrel is effectively distributed throughout the gun barrel and dissipated therefrom.

The gun barrel has an evacuator 4 provided approximately in its mid portion, and is gradually reduced in diameter from its base end to its free end, as shown in FIG. 3. The heat pipe assembly 3 is, therefore, composed of a plurality of annular pipe sections having different inside diameters suited for different portions of the gun barrel 2 having different outside diameters. This arrangement has the advantage of facilitating the manufacture of the heat pipe assembly and its mounting on the gun barrel, although a unitary construction may be employed if desired. Another advantage of the arrangement resides in the possibility of preventing the failure of the heat pipe assembly as a whole in the event only a part thereof has been damaged by a gun shot.

The gun barrel and the heat pipe assembly have different coefficients of thermal expansion, as the former is made of special steel, for example, Ni-Cr-Mo steel, while the latter is preferably formed from stainless steel. The use of the heat pipe assembly 3 composed of separate pipe sections has, therefore, the advantage of reducing the thermal stress which arises due to the different coefficients of thermal expansion.

Figure 4:
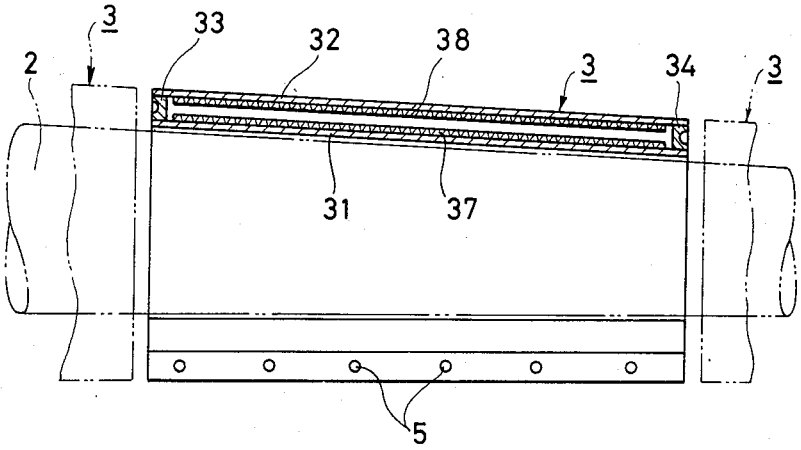
FIG. 4 is a side elevational view, partly in section, of a heat pipe embodying this invention.
Figure 5:
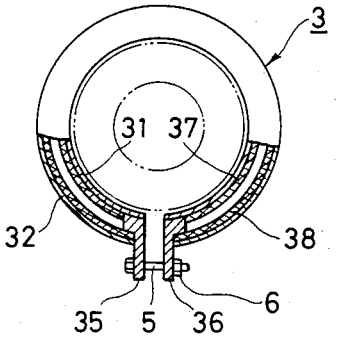
FIG. 5 is an end view, partly in section, of the heat pipe shown in FIG. 4.

Referring to FIGS. 4 and 5, each heat pipe section 3 includes an inner pipe 31 having an axial slit, an outer pipe 32 surrounding the inner pipe 31 and having an axial slit aligned with the axial slit of the inner pipe 31, a pair of end plates 33 and 34 each disposed sealingly between the inner and outer pipes 31 and 32 at one end thereof, and a pair of flanges 35 and 36 welded to the inner and outer pipes 31 and 32 on the opposite side of the axial slits from each other. Thus, the pipe section 3 is of the closed double-cylindrical construction and has a generally C-shaped cross section. The inner and outer pipes 31 and 32 define therebetween a closed annular space which contains a working fluid and a pair of wicks 37 and 38 disposed in intimate contact with the outer surface of the inner pipe 31 and the inner surface of the outer pipe 32, respectively. The pipe section 3 can be fitted about the gun barrel 2 if the slit defined between the flanges 35 and 36 is widened. The flanges 35 and 36 are connected to each other by bolts 5 and nuts 6 at a plurality of points. The wicks 37 and 38 are impregnated with a sufficiently large quantity of the working fluid to wet the wall surfaces of the inner and outer pipes 31 and 32, respectively.

If the heat pipe 3 is exposed to the sun, only a portion of its outer pipe 32 is exposed to sunlight and the working fluid in the wick 38 on the inner surface of that portion is vaporized so that heat is thereby transferred to the remaining portions of the outer pipe 32 and the inner pipe 31, which are not exposed to sunlight, to achieve a uniform dispersion of heat throughout the gun barrel. The wick 38 constantly supplies the working fluid to the inner surface of the outer pipe 32 where its vaporization takes place so that the downward transfer of heat can continuously occur. When the gun is fired, heat is generated principally at the base end of the barrel 2. This heat vaporizes the working fluid on the outer surface of the inner pipe 31, and the vaporized fluid is condensed on the inner surface of the outer pipe 32, whereby the heat is dissipated from the gun barrel 2. The wick 37 constantly supplies the working fluid to the outer surface of the inner pipe 31 where its vaporization takes place to effect the radial and axial transfer of heat. It is, therefore, necessary to maintain the working fluid in a sufficient quantity to wet the inner surface of the outer pipe 32 and the outer surface of the inner pipe 31.

The transfer of heat by the repeated vaporization and condensation of the working fluid thus achieves a uniform dispersion of heat on the gun barrel and its cooling simultaneously. Although the heat pipe assembly 3 can be disposed in direct contact with the gun barrel 2 without giving rise to any problem, it is preferable to provide therebetween a compound which improves the transfer of heat from the gun barrel to the heat pipe assembly to a further extent. The wicks 37 and 38 may be replaced by annular grooves which supply the working fluid to the pipe surfaces by capillary action.

Figure 6:
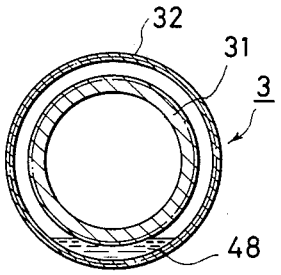
FIG. 6 is a cross sectional view of a heat pipe according to a second embodiment of this invention.
Figure 7:
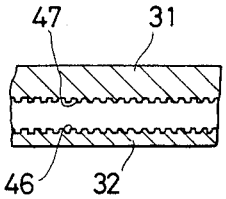
FIG. 7 is a fragmentary sectional view showing an annular groove in the heat pipe of FIG. 6.
Figure 8:
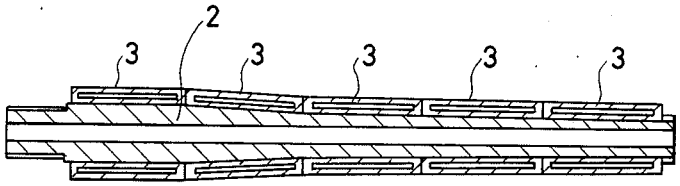
FIG. 8 is a longitudinal sectional view showing by way of example a gun barrel on which the heat pipe of FIG. 6 is provided.

FIGS. 6 to 8 show an inner pipe 31 and an outer pipe 32 which are provided with annular grooves 47 and 46, respectively. The annular grooves 46 and 47 are sufficiently small in width to provide a capillary action. The annular grooves 46 are formed in the inner surface of the outer pipe 32, and the annular grooves 47 in the outer surface of the inner pipe 31. The annular space between the inner and outer pipes 31 and 32 contains a working fluid 38 in a sufficient quantity to wet the wall surfaces of those pipes. FIG. 8 shows a plurality of annular heat pipe sections 3 each having annular grooves, as hereinabove described, and surrounding a gun barrel 2.

As is obvious from the foregoing description, the heat pipe assembly surrounding the gun barrel accomplishes the transfer of locally generated heat by vapor to disperse it uniformly throughout the gun barrel and dissipate it therefrom to thereby impart improved accuracy to a gun.

Figure 9A:
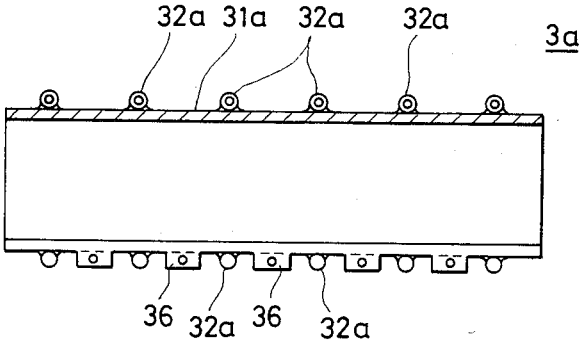
FIGS. 9 (*a*) and 9 (*b*) are a longitudinal sectional view and a transverse sectional view, respectively, of a heat pipe according to a third embodiment of this invention.
Figure 9B:
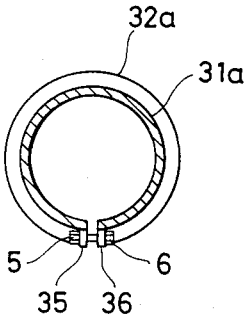
Figure 10:
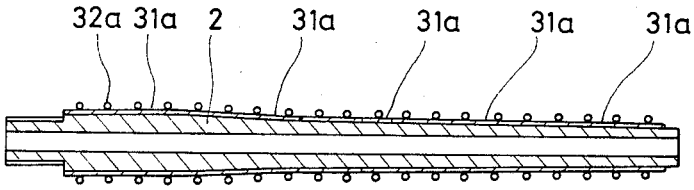
FIG. 10 is a longitudinal sectional view showing by way of example a gun barrel on which the heat pipe of FIGS. 9 (*a*) and 9 (*b*) is provided.

A third embodiment of this invention is shown in FIGS. 9 (*a*), 9 (*b*) and 10. A heat pipe assembly 3*a* contains a cylindrical heat distributing plate or cylinder 31*a* and a plurality of annular pipes 32*a* surrounding the cylinder 31*a* and bonded thermally thereto, for example, by brazing or welding. The cylinder 31*a* has an axially extending slit which enables the cylinder 31*a* to be fitted about a gun barrel 2, and a plurality of pairs of flanges 35 and 36 projecting from the edges of the slit. The pairs of flanges 35 and 36 are connected to each other by bolts 5 and nuts 6 to hold the cylinder 31*a* in intimate contact with the gun barrel 2. FIG. 10 shows the heat pipe assembly 3*a* secured to the gun barrel 2, and the heat pipe assembly 3*a* shown therein includes a plurality of heat distributing cylinders 31*a*.

If the heat pipe assembly 3*a* is exposed to the sun, those portions of the cylinders 31*a* and the annular pipes 32*a* which are exposed to sunlight are heated, and the working fluid in the annular pipes 32*a* is vaporized. The vaporized fluid flows into and heats the lower temperature portions of the annular pipes 32*a* which are not exposed to sunlight, and thereby heats the entire cylinders 31*a* to a substantially uniform temperature. It is, therefore, possible to avoid localized heating of the gun barrel by sunlight and thereby prevent its flexure so that the gun has an improved accuracy or hit probability.

Figure 11:
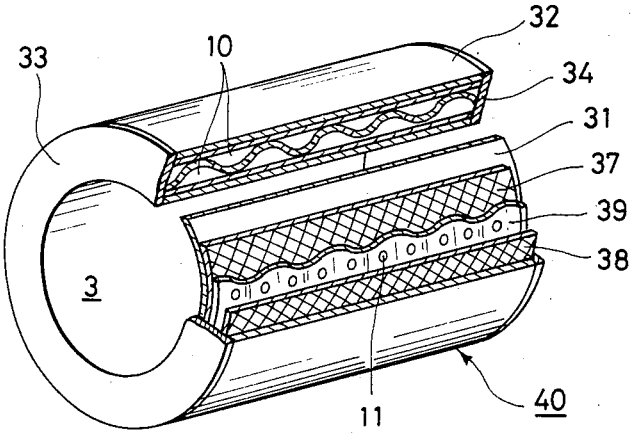
FIGS. 11 to 13 are a perspective view partly in section, a transverse sectional view, and a longitudinal sectional view, respectively, of a heat pipe according to a fourth embodiment of this invention.
Figure 12:
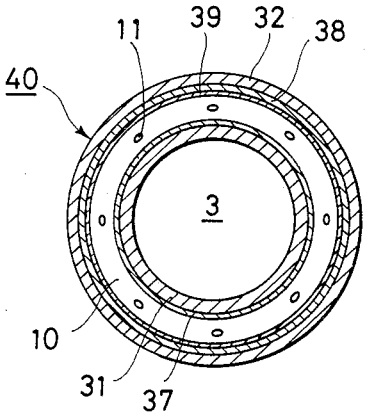
Figure 13:
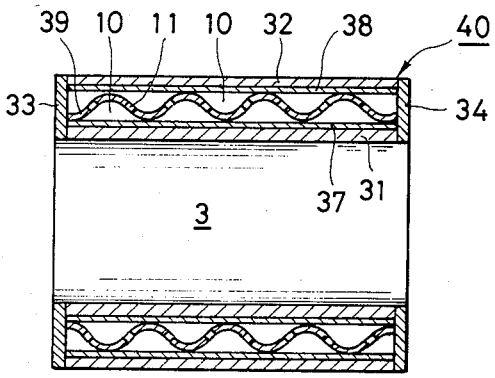
Figure 14:
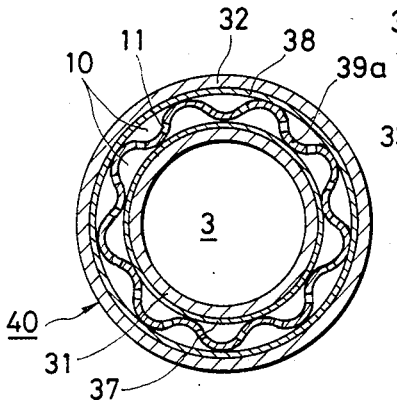
FIGS. 14 and 15 are views similar to FIGS. 12 and 13, respectively, but showing a modified heat pipe.
Figure 15:
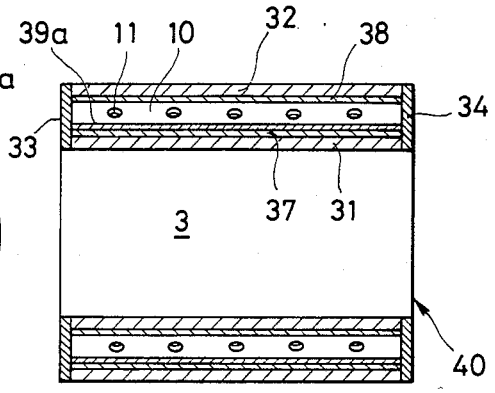

Further improvements are shown in FIGS. 11 to 13 which illustrate a fourth embodiment of this invention. A modification to the structure of FIGS. 11 to 13 is shown in FIGS. 14 and 15, and another modification in FIGS. 16 and 17. Referring first to FIGS. 11 to 13, an annular heat pipe 3 has the double-cylindrical construction, and is composed of a closed annular housing 40 which is defined by an inner cylinder 31, an outer cylinder 32, and a pair of end plates 33 and 34. A pair of wicks 37 and 38 impregnated with a working fluid are disposed in the housing 40, and held in position by a wick support 39. Each of the wicks 37 and 38 is formed by a mat of inorganic fiber, such as carbon or glass fiber, sandwiched between a pair of wire nets. The wick 37 is held in intimate contact with the outer surface of the inner cylinder 31, and the wick 38 in intimate contact with the inner surface of the outer cylinder 32. The wick support 39 is formed from a sheet of material having a low degree of thermal conductivity, such as stainless steel or a high molecular weight substance. The wick support 39 is a generally cylindrical body having a corrugated wall, and its corrugations lie at right angles to the longitudinal axis of the heat pipe 3. The corrugations contact the wick 37 on the inner cylinder 31 and the wick 38 on the outer cylinder 32 alternately, and provide a spring action to hold the wicks 37 and 38 against the surfaces of the inner and outer cylinders 31 and 32, respectively. The wick support 39, therefore, defines a multiplicity of annular vapor passages 10 which are juxtaposed along the axis of the heat pipe 3. The wick support 39 has a multiplicity of holes 11 which enable vapor to flow between every two adjoining passages 10. The housing 40 has a reduced pressure and contains a small quantity of a working fluid which may, for example, be methanol, acetone, Freon TM, water or other vaporizable liquid as known in the art.

If the outer cylinder 32 is locally exposed to sunlight, the heat thereby generated is transferred to the wick 38 contacting the outer cylinder 38 and vaporizes the working fluid in the wick 38. The resulting vapor spreads instantaneously throughout the whole housing 40 through the annular vapor passages 10 and the vapor holes 11, and is condensed on the lower temperature portions of the cylinder surface and the wick. The resulting liquid flows back through the wick 37 into the area where vaporization takes place. This cycle of vaporization and condensation enables the locally generated heat to spread over the entire periphery of the heat pipe in the form of heat of vaporization to achieve a uniform distribution of heat in the gun barrel.

The wick support 39 is formed from a material of low thermal conductivity, and as only its corrugations contact the wicks, the area in which the conduction of heat may occur between the wicks and the wick support is very small. It is therefore possible to restrict to a very small quantity the heat which is locally transferred through the wick support 39. The transfer of heat between the vaporized fluid and the condensed fluid takes place instantaneously in a large quantity without creating any appreciable temperature difference, but the conduction of heat through the wick support is confronted with a great resistance creating a large temperature difference between the high and low temperature areas. The conduction of heat through the wick support 39 is even likely to have an adverse effect on the performance of the heat pipe which is provided for achieving the uniform distribution of heat in the gun barrel. It is, therefore, highly desirable to restrict any such conduction of heat as far as possible and obtain the full dispersion of heat by the vaporization and condensation of the working fluid. The wick support constructed as shown in FIGS. 11 to 13 ensures for the heat pipe a high degree of performance in the uniform distribution of heat for the gun barrel.

The heat generated in the gun barrel when the gun is fired is transferred to the wick 37 contacting the inner cylinder 31 and vaporizes the working fluid in the wick 37. The resulting vapor spreads instantaneously over the whole periphery of the heat pipe, and is condensed on the low temperature portions of the cylinder surface and the wick, whereby heat is uniformly distributed in the gun barrel and dissipated therefrom.

A modification to the fourth embodiment of this invention is shown in FIGS. 14 and 15. It differs from the heat pipe of FIGS. 11 to 13 in the construction of the wick support. The corrugations of the wick support 39*a* shown in FIGS. 14 and 15 extend parallel to the longitudinal axis of the heat pipe 3 and define a multiplicity of vapor passages 10 juxtaposed circumferentially of the heat pipe 3. Each two adjoining vapor passages 10 are connected with each other by a plurality of vapor holes 11. The heat pipe enables the uniform distribution of heat around the entire periphery of a gun barrel, as does the heat pipe of FIGS. 11 to 13. The wick support 39*a* has the advantage of being easier to manufacture, and it provides a better support for the wicks than the wick support 39 of FIGS. 11 to 13.

Figure 16:
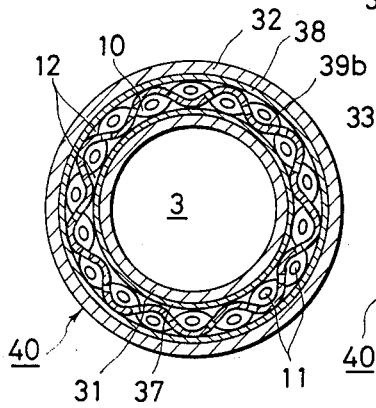
FIGS. 16 and 17 are also views similar to FIGS. 12 and 13, respectively, but showing another modified heat pipe.
Figure 17:
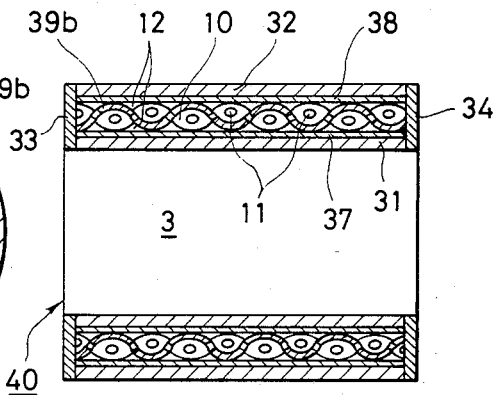

Another modification is shown in FIGS. 16 and 17. This modification is characterized by a wick support 39b having a plurality of first corrugations extending parallel to the longitudinal axis of the heat pipe 3 and a plurality of second corrugations lying at right angles thereto. Not only the vapor holes 11, but also the clearances 12 defined between the adjoining corrugations define a multiplicity of vapor passages both circumferentially and longitudinally of the heat pipe 3 to promote the movement of vapor to a further extent. The wick support 39*b* does not substantially contact the wicks except at the points where the corrugations intersect one another, and the area which is available for the conduction of heat between the wicks and the wick support is, therefore, further reduced. The wick support can be formed from a corrugated wire net instead of from a sheet. The use of a wire net has the advantage of eliminating the necessity of forming the vapor passages between the opposite sides of the wick support.

As is obvious from the foregoing, the fourth embodiment of this invention and its modifications are all characterized by providing a wick support having a corrugated cross section, a small weight and a high degree of impact resistance, formed with vapor holes and providing a spring action to hold the wicks in intimate contact with the adjacent wall surfaces of the closed annular housing. As the wick support has only a small area of contact with the wicks and has a high thermal resistance, it is possible to keep the conduction of heat through the wick support at a low level and obtain the full distribution of heat by the vaporization and condensation of the working fluid to quickly disperse any localized heat in the gun barrel and cool it effectively.

When the gun is fired, a reaction force having a maximum acceleration of about 350 Gs acts on the gun barrel and the heat pipe. The use of a resilient wick support for holding the wicks formed from a mat of fiber against the inner wall surfaces of the closed housing is not sufficient to bear any such large impact without allowing the wicks to be displaced toward the free end of the gun barrel. The wicks are difficult to return to their original position and render the heat pipe incapable of working satisfactorily.

Figure 18:
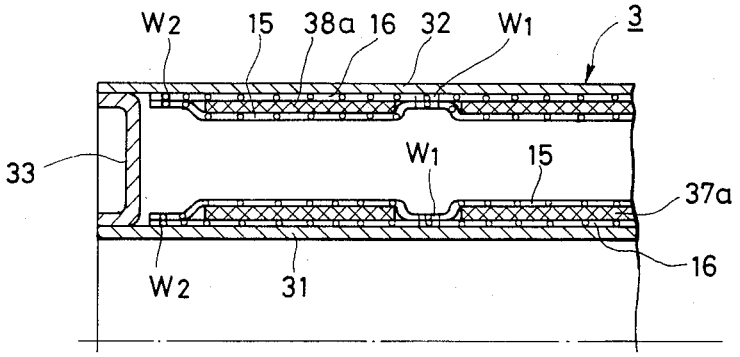
FIG. 18 is a fragmentary longitudinal sectional view of a heat pipe according to a fifth embodiment of this invention.
Figure 19:
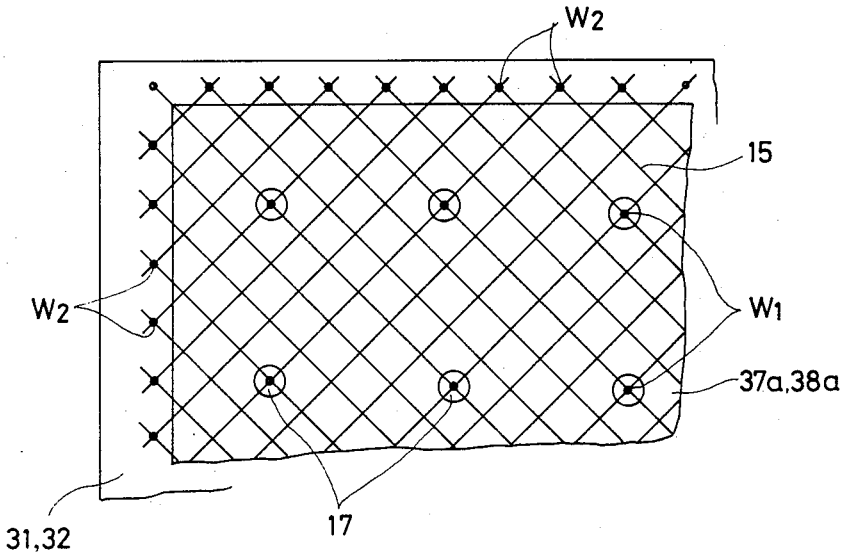
FIG. 19 is an exploded top plan view of the heat pipe shown in FIG. 18.

This problem is solved by a fifth embodiment of the invention which is shown in FIGS. 18 and 19. Each of wicks 37*a* and 38*a* here is composed of a mat of fiber sandwiched between a pair of wire nets 15 and 16. Each wick 37*a* or 38*a* has a multiplicity of small holes 17 in which the inner and outer wire nets 15 and 16 are held against each other. The wire nets are spot welded to the peripheral surfaces of the inner and outer cylinders 31 and 32 at the wick holes $W_1$ and at a multiplicity of points $W_2$ along the edges of the wire nets to hold the wicks 37*a* and 38*a* in position on the peripheral surfaces of the inner and outer cylinders 31 and 32, respectively. The wicks are placed in position before the sheets forming the inner and outer cylinders 31 and 32 are rounded to define the closed annular housing.

As the wicks 37*a* and 38*a* are each sandwiched between the wire nets 15 and 16 which are joined to each other through the holes 17 of the wicks and welded to the inner wall surfaces of the closed housing, the wicks 37*a* and 38*a* are not displaced in the housing, but are reliably held in position, even if they are subjected to a large reaction force when the gun is fired. It is advisable to ensure that the points at which the wire nets 15 and 16 are welded are distributed as uniformly as possible over the wicks, and that the holes 17 are as small in diameter as possible since they break the passage for the working fluid in the wicks. Although FIG. 18 shows each wick sandwiched between two wire nets 15 and 16, it is possible to omit the wire nets 16 between the wicks and the adjacent wall surfaces and weld only the wire nets 15 to the adjacent wall surfaces of the inner and outer cylinders 31 and 32.

According to the fifth embodiment of the invention, the wicks can reliably be held in position without undergoing any displacement in the housing despite any reaction force acting on the gun barrel and the heat pipe when the gun is fired since each wick, which is formed from a mat of fiber, is supported by at least one wire net welded to the inner wall surface of the housing through the wick holes. The use of the wire nets for supporting the wicks does not impair the function of the wicks in any way, but enables the reliable and fully effective distribution of heat by the vaporization and condensation of the working fluid, and thereby the realization of a heat pipe which attains an excellent uniform distribution of heat in a gun barrel and rapid dissipation of that heat.

As already stated, a gun barrel of the type herein described in subjected to a large reaction force having a maximum acceleration of about 350 Gs each time the gun is fired. The heat pipe sections 3 according to the first embodiment of the invention, which are individually secured to the gun barrel by the bolts, have the disadvantage that, however slightly the bolts may be loosened during a long period of time, the impact force overcomes the tightening force of the bolts and causes the displacement of the pipe sections 3 on the gun barrel and thereby the repeated collision of their ends against one another. The closed housings can then be damaged at the welded joints and lose their gas tightness, rendering the heat pipe assembly unusable. A similar trouble is likely to arise from the repeated exposure of the pipe sections to the intense heat generated in the gun barrel when the gun is fired or to the heat of the sun. The stainless steel of which the heat pipe sections 3 are made has a higher coefficient of linear expansion than the special steel of which the gun barrel 2 is made. The difference between the gun barrel 2 and the heat pipe sections 3 in the degree of thermal expansion creates a thermal stress in the pipe sections 3. If this thermal stress exceeds the frictional force existing between the gun barrel 2 and the pipe sections 3, the pipe sections 3 are slightly displaced on the gun barrel 2. The repeated occurrence of such displacement brings the closed housings of the pipe sections into abutment with one another. If, under these circumstances, the pipe sections 3 are exposed to heat repeatedly, the welded joints are subjected to thermal stress repeatedly and are eventually broken. Another problem existing in the structure herein discussed is the infiltration of rain water into any slight clearance between the gun barrel 2 and the pipe sections 3, resulting ultimately in the erosion of the gun barrel 2.

Figure 20:
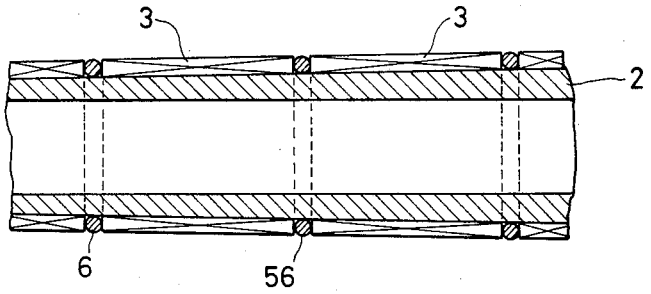
FIG. 20 is a fragmentary longitudinal sectional view showing a gun barrel on which a heat pipe according to a sixth embodiment of the invention is provided.
Figure 21:
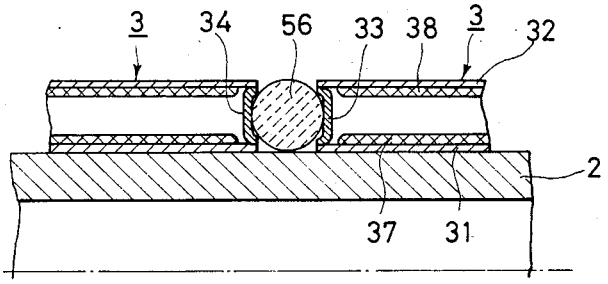
FIG. 21 is a fragmentary enlarged view of the construction shown in FIG. 20.

These problems are solved by a sixth embodiment of the invention which is shown in FIGS. 20 and 21. A heat pipe assembly of this embodiment is formed by a plurality of separate pipe sections 3 fitted about a gun barrel 2 in a mutually spaced and juxtaposed relationship. An elastic damping member 56 in the form of a ring which is formed from an elastic material such as rubber is sandwiched between every two adjoining pipe sections 3. The elastic ring 56 is held in intimate contact with the end plates 33 and 34 of every two adjoining pipe sections 3, serving also as a sealing member.

The elastic rings 56 absorb the impact force acting on the pipe sections 3 when the gun is fired, and prevent collision of the pipe sections 3 with one another. The pipe sections 3 are, therefore, free from any excessively concentrated load, and their welded joints are protected thereagainst. The elastic rings 56 also absorb any difference between the gun barrel 2 and the pipe sections 3 in the degree of thermal expansion which takes place when they are exposed to the heat generated when the gun is fired or to the the heat of the sun. There is no direct contact of the pipe sections 3 with one another, and no thermal stress is concentrated in the welded portions. The sealing function of the elastic rings 56 prevents the infiltration of, for example, rain water into the clearances between the gun barrel 2 and the pipe sections 3 and thereby the erosion of the gun barrel 2.

According to the sixth embodiment of this invention, the elastic damping member disposed between every two adjoining heat pipe sections on the gun barrel ensures the safety of the heat pipe assembly and its improved reliability since it prevents direct contact of the pipe sections despite the impact force acting thereon when the gun is fired, their expansion by the heat generated when the gun is fired, or the heat of the sun, and absorbs any excessive force so that it is not concentrated on the closed housings of the welded construction.

Although the heat pipe sections 3 are individually secured to the gun barrel by the bolts 5 so as to withstand the impact, no satisfactory tightening force is obtained if no sufficient torque has been applied to tighten some of the bolts 5. The pipe sections have, therefore, the disadvantage of being displaced on the gun barrel if a large impact load acts on the pipe sections when the gun is fired. Strict control is thus required for the torque applied to tighten the individual bolts 5 when the pipe sections 3 are mounted on the gun barrel 2.

According to one of the embodiments hereinabove described, a plurality of bolts 5 are used to connect the flat flanges 35 and 36 welded to each heat pipe section. The use of a plurality of bolts 5, however, gives rise to an inclination of the flanges 35 and 36 relative to each other and a deviation from a parallel orientation when the bolts 5 are tightened. This inclination can arise in various ways depending on the individual bolts and is not uniform along the entire length of the flanges. The inclination causes the bolts 5 to bite the edges of the bolt holes in the flanges 35 and 36 when they are tightened. As a result, some of the bolts 5 may become loose, even if an appropriate controlled torque is applied by a torque wrench or the like for tightening all of the bolts. The loosening of some of the bolts and the resulting creep of the flanges which takes place over time give rise to a difference in the tightening force of the bolts along the length of the flanges and thereby make it impossible for the bolts to secure the pipe sections so firmly that they can withstand a large impact load.

Figure 22:
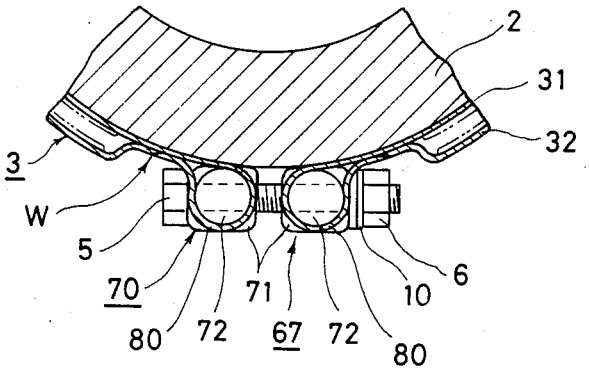
FIGS. 22 to 24 are a fragmentary transverse sectional view, a perspective view, and a bottom plan view, respectively, of a heat pipe according to a seventh embodiment of this invention.
Figure 23:
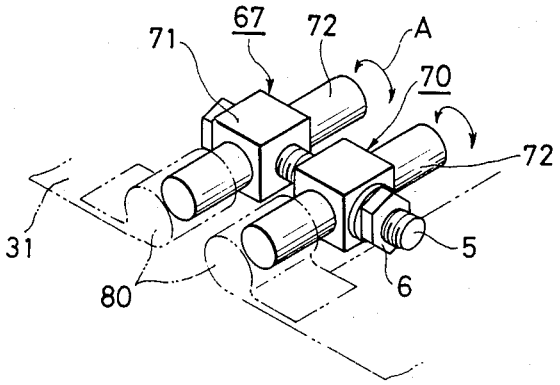
Figure 24:
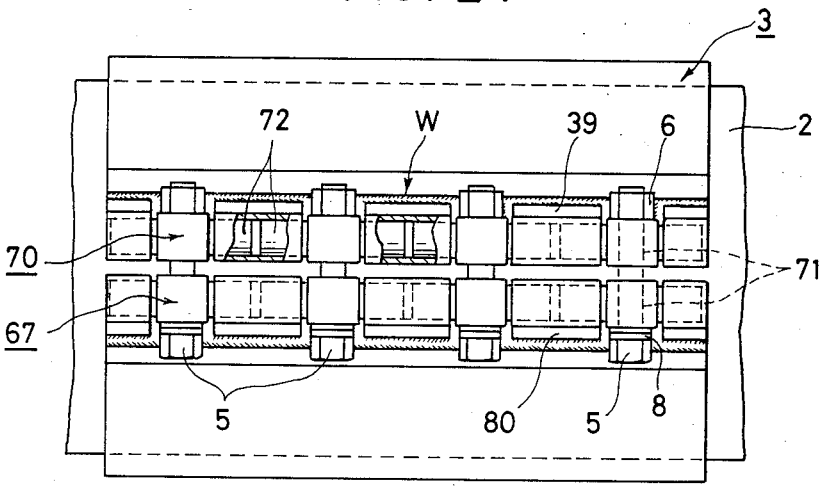
Figure 25:
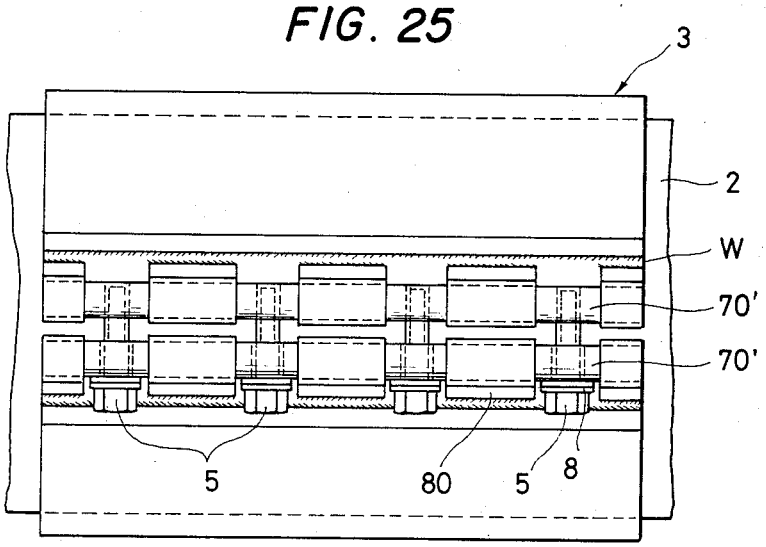
FIG. 25 is a view similar to FIG. 24, but showing a modified structure.

A seventh embodiment of this invention is shown in FIGS. 22 to 24, and a modification thereto in FIG. 25. Referring first to FIGS. 22 to 24, a heat pipe section 3 having a generally C-shaped cross section has an axially extending slit. The edges defining the slit therebetween are each provided with a plurality of rotatable flanges 67 which are so located that each flange 67 on one edge faces a flange 67 on the other edge. Each flange 67 has a central body 71 having a threaded bore for receiving a bolt and a pair of coaxial rotary shafts 72 secured to the opposite sides of the central body 71 and extending at right angles to its threaded bore. Each of the edges defining a slit in an inner cylinder 31 for the pipe section 3 has a plurality of tongues, each folded back and welded to the inner cylinder 31 at W to define a flange support 80 having a circular cross section. Each of the rotary shafts 72 of each flange 67 is fitted in one of the flange supports 80. Each flange 70 provided on the pipe section is rotatable about its rotary shafts 72, as indicated by an arrow line A to adjust the position of its threaded bore.

When the pipe section 3 is fitted about a gun barrel 2, a bolt 5 is inserted through the threaded bores of each pair of flanges 70 facing each other, while a nut 5 is fitted about the bolt 5, and a predetermined torque is applied to tighten the bolt 5. If a spring 8, such as a counter or coiled spring, is fitted about the bolt 5 between the flange 70 and the head of the bolt or between the flange 70 and the nut 6, it absorbs the stress acting on the flange as a result of the diameterical thermal expansion of the gun barrel or the impact produced when the gun is fired.

As each flange 70 is rotatable about is shafts 72, each pair of flanges 70 are always kept parallel to each other when the bolt 5 is tightened to connect them. There is no possibility of the bolt 5 biting any flange 70, but a predetermined torque can be applied to each bolt to tighten it satisfactorily. All the bolts have an equal tightening force and enable the stable mounting of the heat pipe section 3 on the gun barrel 2. As the supports 80 for the flanges 70 are formed by the folded edges of the inner cylinder 31, the force applied to tighten the bolts is transmitted to the inner cylinder 31 to pull its split edges together to achieve closer contact between the gun barrel 2 and the heat pipe section 3 and a higher degree of heat transfer therebetween. The structure according to the seventh embodiment of this invention eliminates the possiblity of loosening of the heat pipe which is likely to occur to the structure of FIG. 5 as the creep of the flat flanges 35 and 36 may create an increased strain with the lapse of time.

A modification to the seventh embodiment of this invention is shown in FIG. 25. While the structure according to the seventh embodiment includes a pair of rotatable flanges 70 for each bolt, the modified structure is characterized by having a single pair of common rotatable flanges 70' for all the bolts. Each flange 70' has a plurality of threaded bolt-receiving bores spaced apart from one another longitudinally along the heat pipe section 3. Each bore in one of the flanges 70' is aligned with one of the bores in the other flange 70'. According to the structure shown in FIG. 25, the bores in one of the flanges 70' are threaded to eliminate the necessity for the use of nuts and to thereby enable the tightening of the bolts by a single tool such as a torque wrench. Alternatively, it is possible to provide a single heat pipe section with both flanges of the type shown in FIG. 24 and flanges of the type shown in FIG. 25.

As is obvious from the foregoing description, the seventh embodiment of the invention and its modification are characterized by the provision of at least one pair of mutually facing rotatable flanges on the edges defining the axially extending slit of a heat pipe section having a generally C-shaped cross section, each flange being rotatable about an axis parallel to the longitudinal axis of the heat pipe section, and with the flanges being connected to each other by a bolt to secure the heat pipe section to a gun barrel. The flanges are maintained precisely parallel to each other when the bolt is tightened. An appropriate torque can be applied equally to all the bolts to tighten them uniformly along the entire length of the heat pipe section to thereby mount it on the gun barrel with a high degree of stability.

According to the embodiment hereinabove described, a heat pipe section is fitted about a gun barrel and its flanges are connected by bolts to secure it on the gun barrel. A very large force is, however, required for tightening the bolts to the extent that the heat pipe section can withstand a large impact which is produced when the gun is fired. If the bolts are loose, it is likely that the heat pipe section may be displaced on the gun barrel. It is very difficult to manufacture and mount the heat pipe section in such a manner that the entire inner peripheral surface of its inner cylinder is brought into intimate contact with the outer peripheral surface of the gun barrel. There is, therefore, only a low degree of heat transfer between the gun barrel and the heat pipe, and the heat pipe fails to distribute heat uniformly in the gun barrel and dissipate it therefrom effectively.

Figure 26:
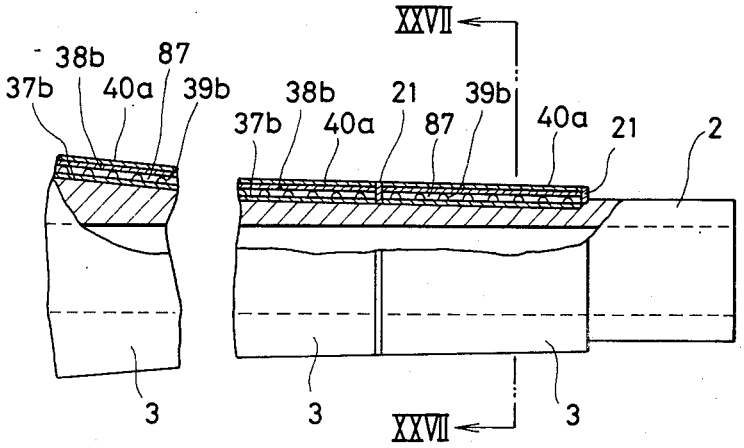
FIG. 26 is a fragmentary side elevational view, partly in section, of a heat pipe according to an eighth embodiment of this invention.
Figure 27:
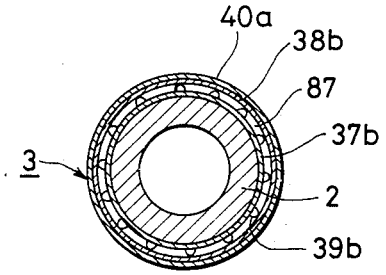
FIG. 27 is a transverse sectional view taken along a line XXVII—XXVII in FIG. 26.

An eighth embodiment of this invention intended to remedy this drawback is shown in FIGS. 26 and 27. A plurality of appropriately spaced-apart annular partitions 21 are provided about a gun barrel 2. A cylindrical metal housing 40*a* surrounding the gun barrel 2 is provided between every two adjoining partitions 21 and welded or brazed thereto in a gas-tight fashion. The inner peripheral surface of the housing 40*a* and the outer peripheral surface of the gun barrel 2 define therebetween a closed annular working space 87 in which the vaporization and condensation of a working fluid take place. Each area defined between every two adjoining partitions 21 includes a wick 37*b* contacting the outer peripheral surface of the gun barrel 2 and a wick 38*b* contacting the inner peripheral surface of the housing 40*a*. Each of the wicks 37*b* and 38*b* contains a working fluid. A wire net is, for example, applied to each wick and spot welded to the gun barrel or housing to secure the wick in position. If required, a wick support, which can, for example, be formed from a corrugated wire net, may be disposed between the wicks 37*b* and 38*b*, as shown at 38*b*.

The working space has a reduced pressure and contains a small quantity of working fluid. The vaporization and condensation of the working fluid effect the uniform distribution of heat in the gun barrel and its dissipation therefrom. The structure shown in FIGS. 26 and 27 differs from all the other embodiments hereinbefore described in that the gun barrel 2 per se serves as the inner cylinder of the annular heat pipe 3, and that the working fluid is, therefore, brought into direct contact with the outer peripheral surface of the gun barrel 2 to effect the transfer of heat therebetween. This arrangement ensures a high degree of heat transfer between the gun barrel 2 and the heat pipe 3. The housing 40*a* is welded or brazed to the gun barrel 2, and does not therefore, undergo any axial displacement even if it is subjected to the impact produced when the gun is fired. The absence of the inner cylinder makes the heat pipe 3 lighter and more compact in construction. As a plurality of separate heat pipe sections are provided along the gun barrel, protection of the entire heat pipe assembly is provided, even if one of its sections is damaged by a gun shot, or for any other cause.

The eighth embodiment of this invention is characterized by a plurality of annular heat pipe sections secured integrally to a gun barrel, each having a metal housing surrounding the gun barrel and spaced apart therefrom to define a space for a working fluid, and with the outer peripheral surface of the gun barrel and the inner peripheral surface of the housing each being provided with a wick. The heat pipe structure according to this embodiment has a high degree of impact resistance and ensures a high degree of heat transfer relative to the gun barrel to achieve most effectively the uniform distribution of heat in the gun barrel and its dissipation therefrom.

What is claimed is:

1. A tapered gun barrel having a substantially cylindrical shape and having a longitudinal axis, said barrel being surrounded by a cylindrical heat pipe having the same longitudinal axis as said barrel and containing a working fluid, wherein said heat pipe comprises:

a first inner peripheral surface of substantially cylindrical shape dimensioned to have a first length measured parallel to said longitudinal axis and extending around substantially the entire circumference of said gun barrel, an outer housing of substantially cylindrical shape dimensioned to have said first length and extending around substantially the entire circumference of said gun barrel and having a second inner peripheral surface and an outer peripheral surface, a longitudinal pair of end sealing means extending radially from said first to said inner peripheral surfaces and connecting said first and second inner peripheral surfaces along said entire first length, a circumferential pair of end sealing means circumferentially connecting said first and second inner peripheral surfaces and defining a closed annular space therebetween, and a wick holding said working fluid and disposed in intimate contact with the first inner peripheral surface and the second inner peripheral surface of said outer housing, at least said outer housing and said first and second end sealing means forming a single continuous C-shaped heat pipe that extends around substantially the entire circumference of said gun barrel such that said longitudinal pair of end sealing means are substantially abutting.

2. A gun barrel as set forth in claim 1, further comprising a compound for improving thermal conductivity provided between said heat pipe and said gun barrel.

3. A gun barrel as set forth in claim 1, wherein said second inner peripheral surface of said outer housing and the first inner peripheral surface being each provided with a multiplicity of annular grooves capable of producing a capillary action, said surfaces defining a space for said working fluid therebeteween.

4. A gun barrel as set forth in claim 1, further comprising a generally cylindrical wick support having a corrugated cross section and provided with a plurality of vapor holes, said support holding said wick against at least one of said inner peripheral surfaces.

5. A gun barrel as set forth in claim 4, wherein said support is formed from a material of low thermal conductivity.

6. A gun barrel as set forth in claim 4, wherein said vapor holes are provided for connecting the recesses defined by said corrugated cross section of said support.

7. A gun barrel as set forth in claim 4, wherein said support comprises a wire net.

8. A gun barrel as set forth in claim 1, wherein said heat pipe comprises a plurality of pipe sections disposed along said gun barrel.

9. A gun barrel as set forth in claim 8, further comprising an elastic damping member disposed between every adjoining two of said pipe sections.

10. A gun barrel as set forth in claim 9, wherein said elastic damping member comprises a ring of elastic material serving also as a sealing member between said every two adjoining pipe sections.

11. A gun barrel as set forth in claim 1, wherein said heat pipe comprises a pair of flanges axially extending from said longitudinal pair of end sealing means and facing each other and joined together by at least one bolt and nut.

12. A gun barrel as set forth in claim 11, wherein one of said flanges being provided on one of said longitudinal pair of end sealing means, the other flange being provided on the other one of said end sealing means in said pair, and each of said flanges being rotatable about an axis parallel to the longitudinal axis of said heat pipe.

13. A gun barrel as set forth in claim 12, further comprising a stress absorbing spring disposed between one of said flanges and the head of said bolt.

14. A gun barrel as set forth in claim 12, further comprising a stress absorbing spring disposed between said other flange and said nut.

15. A gun barrel as set forth in claim 12, wherein each of said rotatable flanges comprises a body having a bolt receiving hole and a rotary shaft extending from said body at right angles to said bolt receiving hole, said shaft being rotatably supported by a part of said heat pipe.

16. A gun barrel as set forth in claim 15, wherein said part is a folded projection projecting from one of said edges.

17. A tapered gun barrel having a substantially cylindrical shape and having a longitudinal axis, said barrel being surrounded by a cylindrical heat pipe having the same longitudinal axis as said barrel and containing a working fluid, wherein said heat pipe comprises:

a first inner peripheral surface of substantially cylindrical shape dimensioned to have a first length measured parallel to said longitudinal axis and extending around substantially the entire circumference of said gun barrel, an outer housing of substantially cylindrical shape dimensioned to have said first length and extending around substantially the entire circumference of said gun barrel and having a second inner peripheral surface and an outer peripheral surface, a longitudinal pair of end sealing means extending radially from said first inner peripheral surface to an outer peripheral surface of said outer housing and connecting said first and second inner peripheral surfaces along said entire first length, a circumferential pair of end sealing means circumferentially connecting said first and second inner peripheral surfaces and defining a closed annular space therebetween, and a wick holding said working fluid and disposed in intimate contact with the first inner peripheral surface and the second inner peripheral surface of said outer housing, at least said outer housing and said first and second end sealing means forming a single continuous C-shaped heat pipe that extends around substantially the entire circumference of said gun barrel such that said longitudinal pair of end sealing means are substantially abutting and, a wire net for supporting said wick, said wick having a plurality of holes which enable said wire net to contact at least one of said first and second peripheral surfaces, said wire net being welded to said at least one peripheral surface at least at one of said plurality of holes.

18. A gun barrel as set forth in claim 17, wherein said wire net has an outer edge welded to said at least one of said first and second inner peripheral surfaces.

19. A gun barrel as set forth in claim 17, further comprising another wire net, said wick being sandwiched between said two wire nets, which are both welded to said first and second inner peripheral surfaces through said holes of said wick.

20. A gun barrel as set forth in claim 19, wherein said wire nets have outer edges welded to a respective one of said first and second inner peripheral surfaces.

21. A tapered gun barrel having a substantially cylindrical shape and having a longitudinal axis, said barrel being surrounded by a cylindrical heat pipe having the same longitudinal axis as said barrel and containing a working fluid, wherein said heat pipe comprises:

a first inner peripheral surface of substantially cylindrical shape dimensioned to have a first length measured parallel to said longitudinal axis and extending around substantially the entire circuucmference of said gun barrel, an outer housing of substantially cylindrical shape dimensioned to have said first length and extending around substantially the entire circumference of said gun barrel and having a second inner peripheral surface and an outer peripheral surface, a longitudinal pair of end sealing means extending radially from said first inner peripheral surface to an outer peripheral surface of said outer housing and connecting said first and second inner peripheral surfaces along said entire first length, a circumferential pair of end sealing means circumferentially connecting said first and second inner peripheral surfaces and defining a closed annular space therebetween, and a wick holding said working fluid and disposed in intimate contact with the first inner peripheral surface and the second inner peripheral surface of said outer housing, at least said outer housing and said first and second end sealing means forming a single continuous C-shaped heat pipe that extends around substantially the entire circumference of said gun barrel such that said longitudinal pair of end sealing means are substantially abutting; and wherein said outer housing comprises a metal housing surrounding said gun barrel and being spaced apart from its outer peripheral surface to define a space for said working fluid, said second inner peripheral surface being provided with a wick, and said outer peripheral surface of said gun barrel comprising said first inner peripheral surface and also being provided with a wick.

22. A gun barrel as set forth in claim 21, wherein said housing comprises a plurality of sections disposed along said gun barrel and each defining a closed space for said working fluid which is independent of the closed spaces defined by the other housing sections.

23. A tapered gun barrel surrounded by a cylindrical heat pipe means, said heat pipe means comprising:

an inner cylinder means defining a first internal surface, an outer cylinder means defining a second internal surface and cylinder closure means, said inner and outer cylinder means and said closure means defining a closed annular space therebetween comprising said first and second internal surfaces;

a wick means holding a working fluid and disposed in intimate contact with the first and second internal surfaces of said heat pipe means, the improvement comprising a plurality of holes dispossoed within said wick means, a wire net means adapted to support said wick means, said wire net means being in contact with said internal surfaces and being welded to said internal surfaces at a plurality of points.

24. A gun barrel as set forth in claim 23 wherein said wire net means comprises a first and a second net surrounding said wick and joined together at said holes in said wick, thereby forming a sandwich material.

25. The invention of claim 23 wherein said wire net means is welded to said internal surfaces at the outer edge of said wire net means.

26. A tapered gun barrel surrounded by a cylindrical heat pipe means, said heat pipe means comprising:

an inner cylinder means defining a first internal surface, an outer cylinder means defining a second internal surface and cylinder closure means, said inner and outer cylinder means and said closure means defining a closed annular space therebetween comprising said first and second internal surfaces;

a wick means holding a working fluid and disposed in intimate contact with the first and second internal surfaces of said heat pipe means, the improvement comprising a plurality of holes disposed within said wick means, a wire net means adapted to support said wick means, said wire net means being in contact with said internal surfaces and being welded to said internal surfaces at a plurality of points, and said wire net means being adapted to be welded to said internal surfaces at the point of said holes in said wick.

* * * * *